US006960096B2

(12) United States Patent
Takada

(10) Patent No.: US 6,960,096 B2
(45) Date of Patent: Nov. 1, 2005

(54) INTERMEDIATE ELECTRICAL CONNECTOR

(75) Inventor: Toshiyuki Takada, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/822,754

(22) Filed: Apr. 13, 2004

(65) Prior Publication Data

US 2004/0209520 A1 Oct. 21, 2004

(30) Foreign Application Priority Data

Apr. 15, 2003 (JP) ..... 2003-109945

(51) Int. Cl.[7] ..... H01R 13/64
(52) U.S. Cl. ..... 439/377; 439/327
(58) Field of Search ..... 439/377, 378, 439/374, 327, 328

(56) References Cited

U.S. PATENT DOCUMENTS 3,801,953 A * 4/1974 Lynch ..... 439/377
4,223,973 A * 9/1980 Tamburro ..... 439/377
5,109,318 A * 4/1992 Funari et al. ..... 361/710
6,233,154 B1 * 5/2001 Farnworth et al. ..... 361/752
6,305,966 B1 * 10/2001 Arbogast et al. ..... 439/377
6,722,908 B2 * 4/2004 Llapitan et al. ..... 439/327

FOREIGN PATENT DOCUMENTS

JP 2001-143786 5/2001

* cited by examiner

*Primary Examiner*—Hien Vu
(74) *Attorney, Agent, or Firm*—Takeuchi & Kubotera, LLP

(57) ABSTRACT

An intermediate electrical connector comprises a circuit board (10) having a plurality of contact portions (11) arranged on opposed edges thereof to which two connectors are attached in opposed directions, respectively, and a pair of supported portions (13, 14) provided at ends thereof in an arrangement direction of the contact portions. The intermediate electrical connector further comprises a guide member (20) holding the circuit board and having a support portion (21) which is brought into contact with an face of the circuit board and a pair of columns (22,13) each having a holding portion (24, 25). The supported portion has an asymmetric shape and the holding portions has a corresponding shape for receiving the asymmetric shape of the supported portion.

3 Claims, 4 Drawing Sheets

INTERMEDIATE ELECTRICAL CONNECTOR

BACKGROUND OF THE INVENTION

1. Field of the Invention

The present invention relates to an intermediate electrical connector having a circuit board and connecting two connectors through the circuit board.

2. Description of the Related Art

This kind of intermediate electrical connector is disclosed in Patent Application Kokai Number 2001-143786.

A connector disclosed in Patent Application Kokai Number 2001-143786 comprises a substantially rectangular circuit board having a plurality of contact portions arranged on opposed edges in a longitudinal direction thereof and functioning as terminals of circuit traces provided in the circuit board, and a guide member for holding the circuit board and guiding two connectors when they are connected to each other.

The circuit board has a symmetric shape with respect to the longitudinal direction and a direction perpendicular to the longitudinal direction. Supported projections are provided at ends of the longitudinal direction and an engagement hole is provided at the center for defining the position of the center.

The guide member has two columns and a supporter extending laterally for coupling the two columns. The support portion is in contact with a face of the circuit board for supporting it and has an engagement projection engaging the engagement hole for defining the position of the circuit board. The columns extend in a plugging direction of the two connectors. Top portions of the columns enter corresponding cavities of the connectors for guiding it to a predetermined position for plugging. The columns have supporting portions which support the supported portions of the circuit board.

Thus, the two connectors are guided by the top portions of the columns and engaged with the circuit board such that the contact portions of the circuit board and terminals of the connectors are brought into contact with each other. Consequently, the two connectors are electrically connected through the circuit board.

The intermediate electrical connector is made by attaching the circuit board to the guide member.

The circuit board is usually symmetric with respect to the longitudinal direction and a direction perpendicular to the longitudinal direction. Accordingly, the intermediate connector can be attached to the guide member in the opposite direction with respect to these two directions.

If the circuit in the circuit board is completely symmetric with respect to these two directions, there is no problem even if the circuit board is attached in the opposite direction. However, in most cases, the circuit is not symmetric even when the external shape is symmetric. Accordingly, if the circuit board is attached in the opposite direction, the intermediate connector does not work and, therefore, an electrical test is necessary to check the opposite attachment after the circuit board is attached.

SUMMARY OF THE INVENTION

Accordingly, it is an object of the present invention to provide an intermediate electrical connector capable of preventing the opposite attachment.

According to an aspect of the present invention, an intermediate electrical connector comprises a circuit board having a plurality of contact portions arranged on opposed edges thereof to which two connectors are attached in opposed directions, respectively and a guide member holding the circuit board and guiding the connectors to a position for connection with the circuit board. The guide member has a support portion which is brought into contact with an face of the circuit board and positions the circuit board at a predetermined position and a pair of columns each having a holding portion provided at sides of the circuit board in the arrangement direction of the contact portions for supporting the circuit board.

At least one of the supported portions has an asymmetric shape in the opposed direction and the arrangement direction of the contact portions and at least one of the holding portions has a corresponding shape for receiving the asymmetric shape of the supported portion.

Accordingly, even if the circuit board has an overall symmetric shape, since the supported portion has the asymmetric shape, the circuit board is attached to the guide member in a predetermined direction and supported at a predetermined position.

The supported portion of the circuit board may have a raised portion extending asymmetrically and the corresponding shape of the holding portion may have a stepped section which abuts against an end surface of the raised portion. Alternatively, the supported portion of the circuit board may have a hole or a cut-off portion at an asymmetric position therein and the corresponding shape of the holding portion may have a projection which is plugged into the hole or the cut-off portion.

DESCRIPTION OF THE PREFERRED EMBODIMENTS

Embodiments of the present invention will now be described below with reference to the accompanying drawings.

Figure 1A:
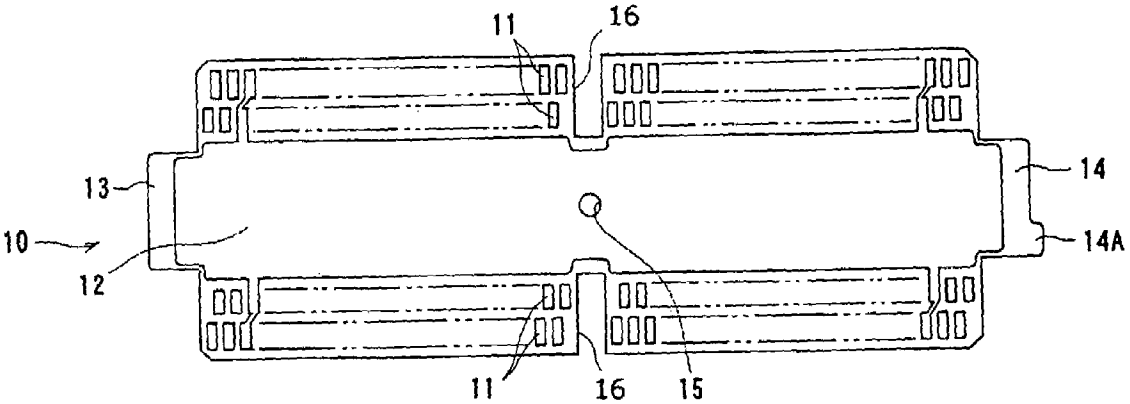
FIG. 1(A) is a front view of a circuit board of an intermediate electrical connector according to an embodiment of the present invention.
Figure 1B:
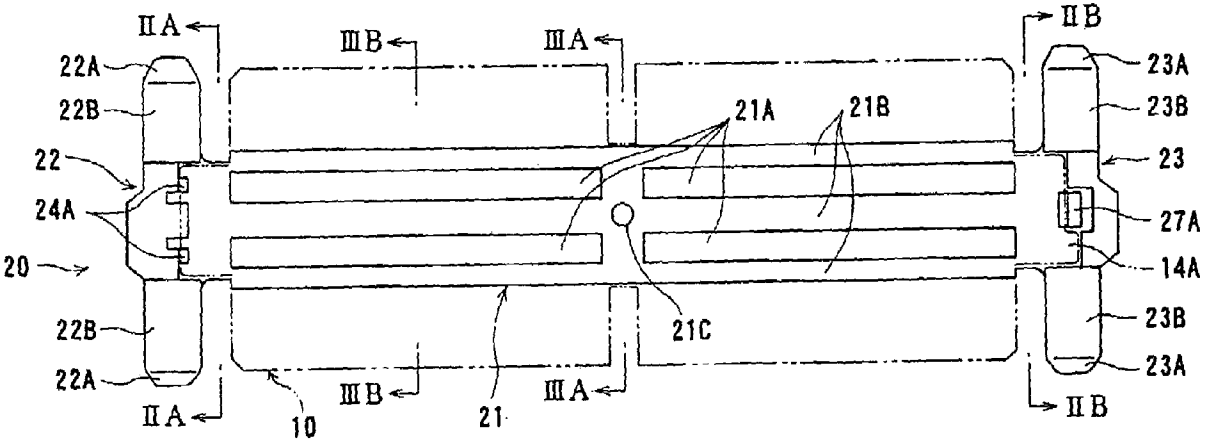
FIG. 1(B) is a front view of a guide member of the intermediate electrical connector, to which the circuit board of FIG. 1(A) is attached.

An intermediate electrical connector according to the present invention is made by attaching a circuit board 10 shown in FIG. 1(A) to a guide member 20 illustrated in FIG. 1(B). In FIG. 1(B), the attached circuit board 10 is shown by a chain line.

The circuit board 10 is made from an electrically insulating material and comprises an inner layer in which a circuit portion is provided and an external layer in which a plurality of contact portions 11 and a shield portion 12 are provided as shown in FIG. 1(A). The circuit board 10 has an oblong rectangular shape and has a pair of cut-off grooves 16 in the center in the longitudinal direction and a pair of supported portions 13 and 14 projecting outwardly from ends thereof. The supported portions 13 and 14 are supported or held by the guide member discussed below. The supported portion 14 on the right side has a raised edge 14A at lower portion thereof. That is, the supported portion 13 on the left side has a straight edge but the supported portion 14 on the right side has a stepped edge because of the presence of the raised edge 14A. Accordingly, the circuit board 10 is asymmetric with respect to both the horizontal and vertical directions because of the presence of the raised edge 14A. Also, an engagement hole 15 is provided in the center of the circuit board 10.

The contact portions 11 are provided along the upper and lower edges of the circuit board 10 in two rows, respectively. The shield portion 12 is provided between the contact portions 11 on the upper and lower edges. Parts of the contact portions 11 in two rows are connected to the shield portion 12 and the other contact portions 11 are connected to corresponding circuit portions in the inner layer. The corresponding circuit portions in the inner layer are covered by the shield portion 12 in the external layer.

The guide member 20 is made by molding an electrically insulating material and comprises, as shown in FIG. 1(B), a substantially platelike support portion 21 extending laterally and a pair of columns 22 and 23 provided at sides thereof in the lateral direction and connected to the support portion 21.

Figure 3B:
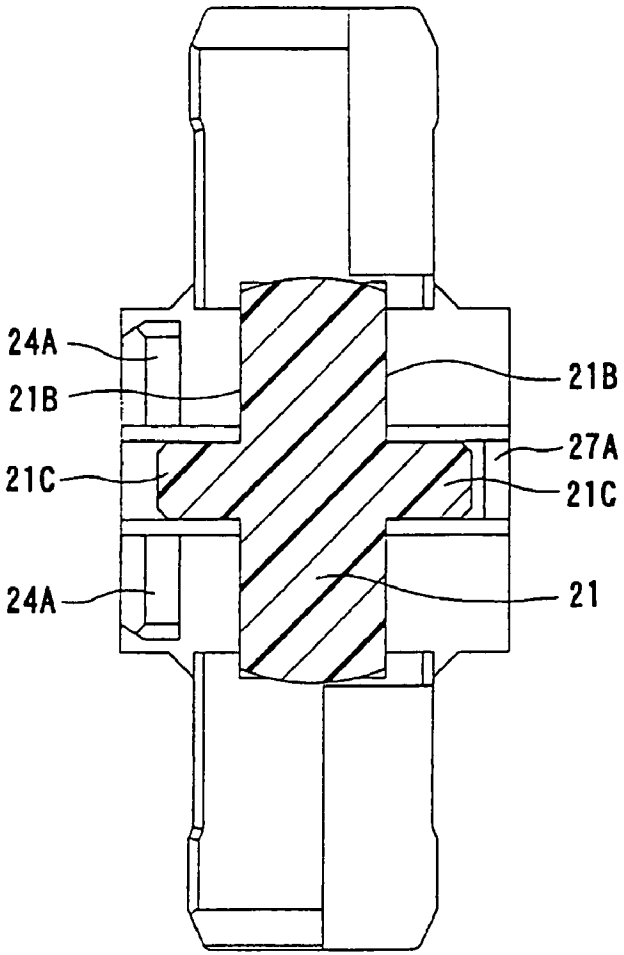
FIGS. 3(A) and 3(B) are sectional views of the guide member taken along the lines 111A—IIIA and IIIB—IIIB, respectively.
Figure 3A:
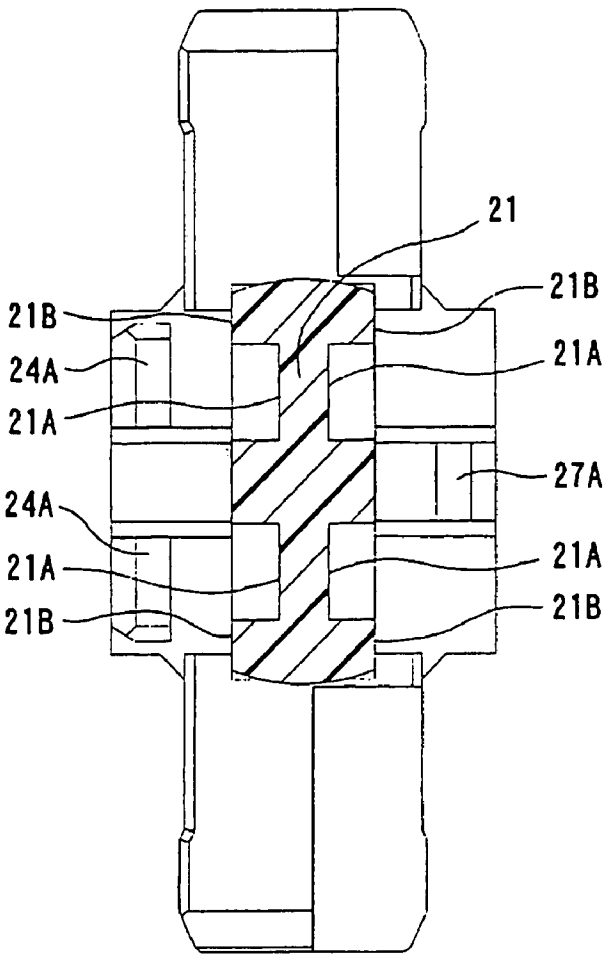

As shown in FIGS. 3(A) and 3(B), a plurality of dents 21A extending laterally are provided on both sides of the support portion 21. Flat surface 21B, which is brought into contact with the circuit board 10, is provided such that it surrounds the dents 21A. A circular projection 21C is provided in the center of the flat surface 21B. The support portion 21 may be brought into contact with circuit board 10 only at sides thereof to support the circuit board 10.

The columns 22 and 23 extend longer in the heightwise direction than the support portion 21. Tapered portions 22A and 23A are provided at the tops of the columns 22 and 23 and guide portions 22B and 23B are provided between the tapered portions 22A and 23A and the support portion 21. The tapered portions 22A and 23A and the guide portions 22B and 23B two connectors (not shown) to predetermined positions when the two connectors are connected to the contact portions 11 of the circuit board 10 from the upper and lower directions, respectively.

Figure 2B:
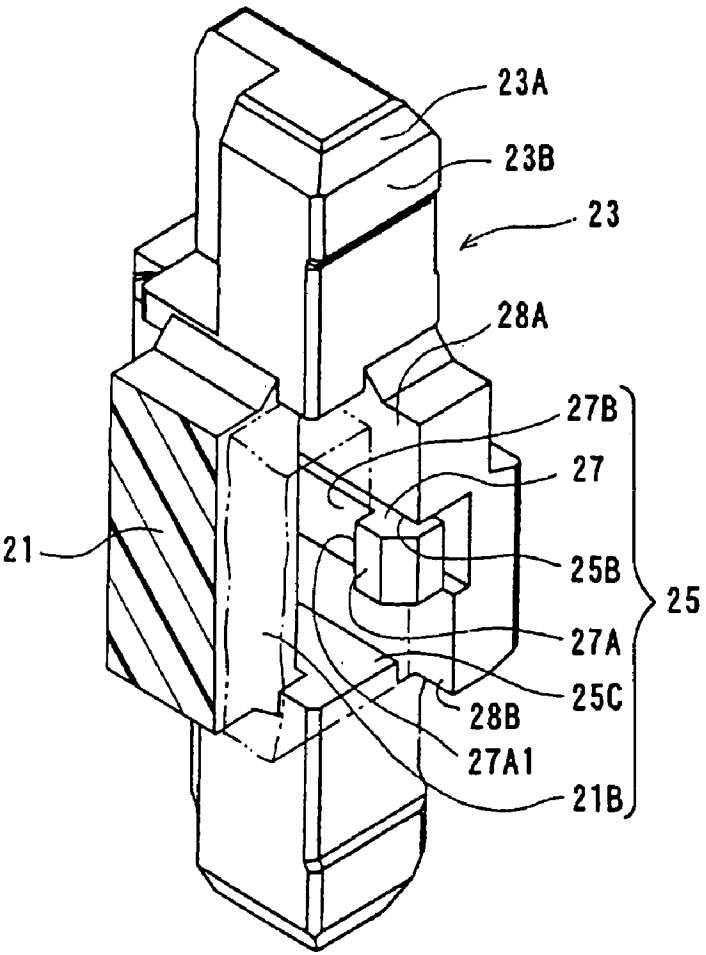
FIG. 2(B) is a perspective view of a right-hand column of the guide member taken along the line IIB—IIB of FIG. 1(B).
Figure 2A:
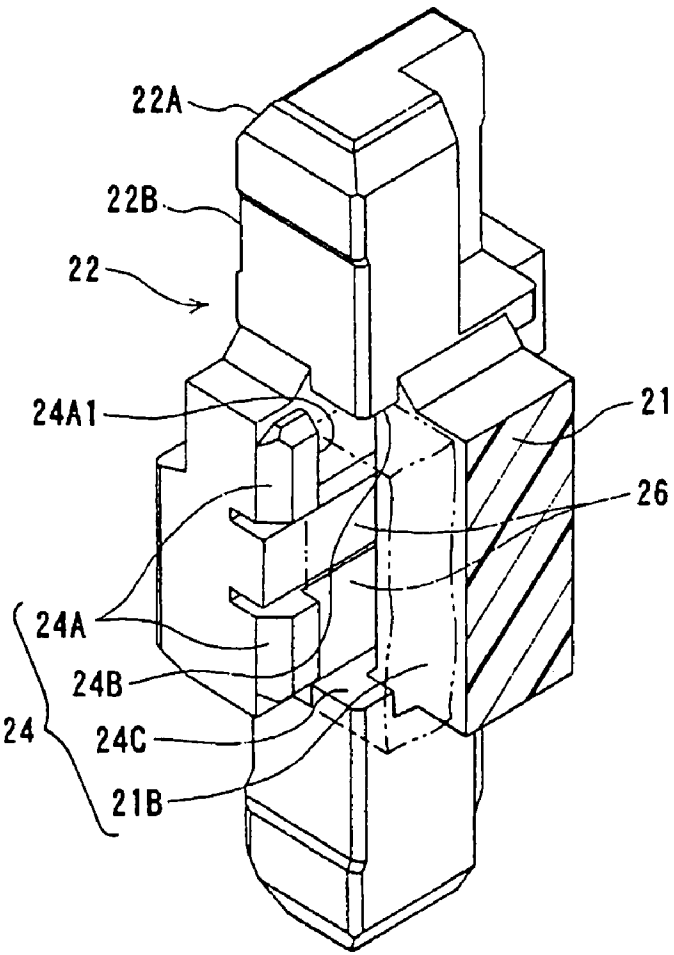
FIG. 2(A) is a perspective view of a left-hand column of the guide member taken along the line IIA—IIA of FIG. 1(B).

As shown in FIGS. 2(A) and 2(B), holding portions 24 and 25 are provided in the columns 22 and 23.

The holding portion 24 provided in the left column 22 is a space into which the supported portion 13 provided at the side of the circuit board 10 is inserted. The space is defined by a support surface 21B of the support portion 21, inner surfaces 24A1 of fixing claws 24A opposed to and spaced from the support surface 21B, and upper and lower receiving surfaces 24B and 24C provided above and below the fixing claws 24A. Accordingly, the distance between the support surface 21B and the inner surface 24A1 of the fixing claw 24A is substantially equal to the thickness of the supported portion 13 and the distance between the upper and lower receiving surfaces 24B and 24C is substantially equal to the width (dimension in the heightwise direction) of the supported portion 13. A rear wall 26 of the holding space is made flat and the end surface of the supported portion 13 abuts against the rear wall when the supported portion is inserted into the holding space.

The column 23 on the right side comprises a flexible engagement arm portion 27 having a hook 27A. The holding portion 25 is defined by an inner surface 27A1 of the hook 27A and the support surface 21B of the support portion 21 opposed to the inner surface 21A1. The holding portion 25 is a space into which the supported portion 14 is provided at the lateral end of the circuit board 10. The space is defined by the inner surface 27A1 of the hook 27A, the support surface 21B, and upper and lower receiving surfaces 25B and 25C. The end surface of the supported portion 14 abuts against an arm surface 27B of the flexible engagement arm 27.

The space of the holding portion 25 is made deeper in the extending (lateral) direction of the support portion 21 at the lower region below the flexible engagement arm 27 than at the upper region of the flexible engagement arm 27. That is, an upper wall surface 28A is positioned deeper in the extending direction than a lower wall surface 28B to make a stepped portion for receiving the raised edge 14A of the supported portion 14 of the circuit board 10.

The holding portions 24 and 25 are provided on the back side of the columns 22 and 23 too in the same way under the condition that the respective holding portions 24 and 25 are replaced with respect to the columns 22 and 23. The stepped portion is provided such that it is positioned on the back side of the column 23. The stepped portion is formed by a hole passing through from the front side to the back side. The position of the stepped portion is not limited to the example shown in the drawings.

The intermediate electrical connector according to the present invention is assembled as follows.

(1) The circuit board 10 is placed at a position corresponding to the support portion 21 of the guide member 20. An end of the circuit board 10 (the left supported portion 13 in FIG. 1) is inserted into the holding space of the holding portion 24 of the guide member 20 shown in FIG. 2(A) such that the end is touched with the fixing claws 24A. At this point, the other end of the circuit board 10 (the right supported portion 14 in FIG. 1) is outside the holding space of the holding portion 25 shown in FIG. 2(B) and the circuit board 10 is inclined such that the supported portion 14 is positioned in front of the sheet in FIG. 1.

(2) The right end of the circuit board 10 is pushed in the rearward direction of the sheet in FIG. 1. The supported portion 14 of the circuit board 10 pushes the hook 27A of the flexible engagement arm portion 27 in the right-hand direction so that the engagement arm portion 27 flexes to the right. When the supported portion 14 climbs over the hook 27A, the engagement arm portion 27 returns to the original position, thus the supported portion 14 is supported by the inner surface 27A1 of the hook 27A.

(3) In addition, the circular projection 21C is plugged into the engagement hole 15 provided in the center of the circuit board 10. Thus, the circuit board 10 is brought into contact with and supported by the flat surface 21B at the position which is determined by the plugging between the engagement hole 15 and the circular projection 21C. The circuit board 10 is also supported at the supported portions 13 and 14 so that the circuit board 10 does not drop off from the regular position.

(4) Since the circuit board 10 is asymmetric horizontally and vertically because of the presence of the raised edge 14A, when the circuit board 10 is attached to the guide member 20, the circuit board 10 is not reverse-attached in a wrong direction by mistake.

(5) Two connectors (not shown) are plugged into the intermediate electrical connector such that the connectors are brought into contact with the contact portions 11 on the upper and lower edges. The tapered portions 22A and 23A and the guide portions 23B and 23B of the columns 22 and 23 guide of the connectors to the proper plugging positions.

The present invention is not limited to the embodiments shown in the drawings and various modifications are possible.

Figure 4:
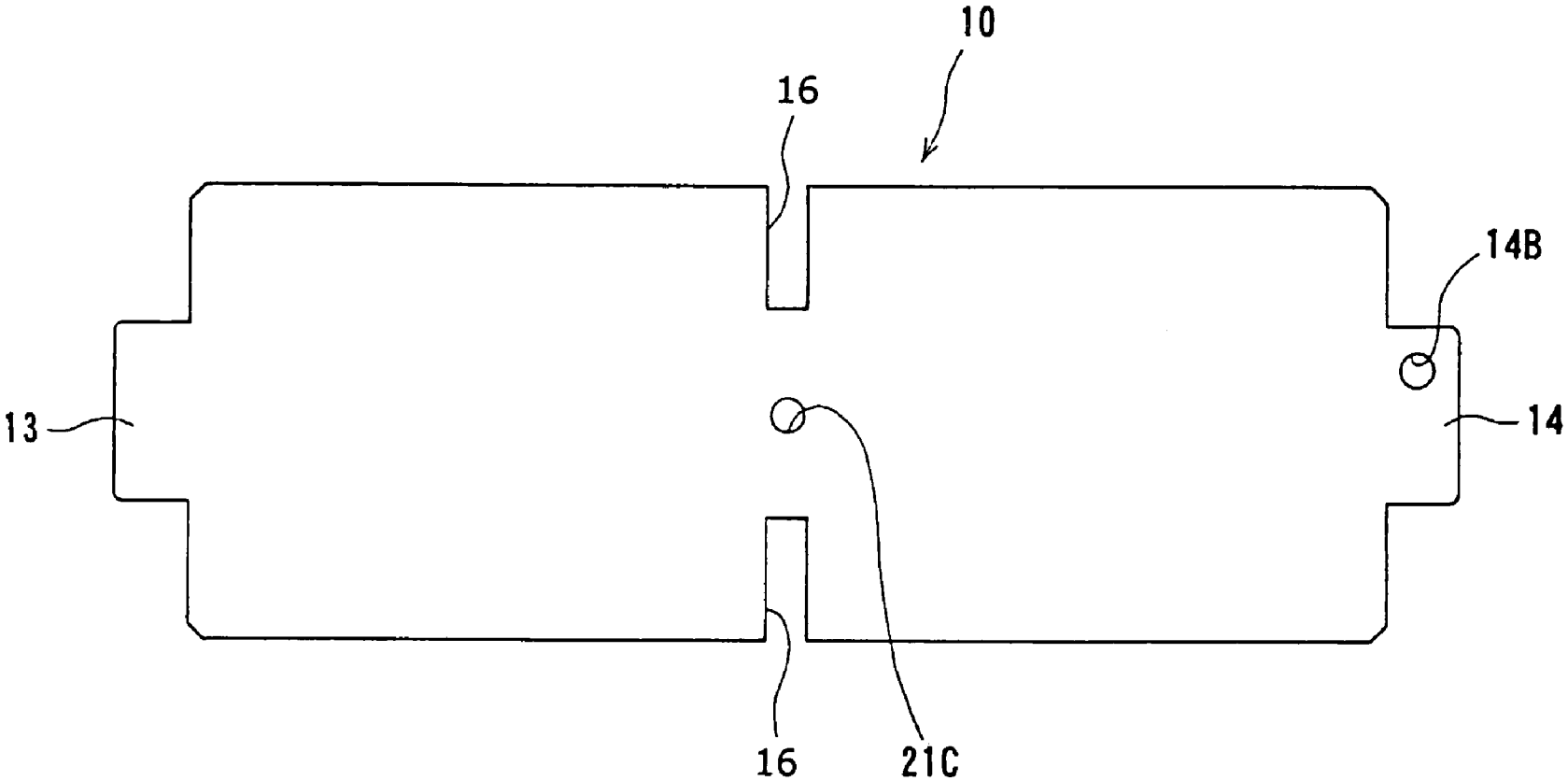
FIG. 4 is a front view of a circuit board according to another embodiment of the present invention, wherein contact portions and so forth are omitted.

For example, the supported portions of the circuit board can be made asymmetric even if they have the same external shape. As shown in FIG. 4, the supported portions 13 and 14 have the same external shape but only the right supported portion 14 is provided with a hole 14B at a vertically asymmetric position. The column 23 of the guide member 20 is provided with a projection which engages the hole 14B to prevent the reverse attachment of the circuit board 10 in a wrong direction. A cut-off portion or a cut portion may be provided instead of the hole if a shape corresponding thereto is provided in the column.

As described above, since the supported portion at end of the circuit board has an asymmetric shape, the attachment of the circuit board to the guide member in a wrong direction is prevented. Accordingly, an inspection to check the reverse attachment becomes unnecessary. Also, since there is no reverse attachment, an intermediate electrical connector having proper functions is provided.

What is claimed is:

1. An intermediate electrical connector comprising:

a circuit board having a plurality of contact portions arranged on opposed edges thereof to engage with two connectors that are attached thereto in opposed directions, respectively, and a pair of supported portions extended at opposite sides of the circuit board and perpendicular to an arrangement direction of said contact portions; and a guide member holding said circuit board and guiding said connectors to a position for connection with said circuit board, said guide member having a support member being brought into contact with a face of said circuit board and supporting said circuit board at a predetermined position and a pair of columns at ends thereof, each of said pair of columns having a holding portion provided at a respective side of the guide member corresponding to that of said supported portion, wherein at least one of said supported portions has an asymmetric shape with respect to both said opposed direction and said arrangement of direction of said contact portions and at least one of said holding portions has a corresponding shape for receiving said asymmetric shape of said at least one of said supported portions therein.

2. The intermediate electrical connector according to claim 1, wherein said supported portion of said circuit board has a raised portion extending therefrom in said arrangement direction asymmetrically with respect to both said opposed direction and said arrangement direction thereby provide said asymmetric shape and said corresponding shape of said holding portion has a stepped section which receives said raised portion.

3. An intermediate electrical connector comprising:

a circuit board having a plurality of contact portions arranged on opposed edges thereof to engage with two connectors that are attached in opposed directions, respectively, and a pair of supported portions extended at opposite sides of the circuit board and perpendicular to an arrangement direction of said sides of the circuit board and perpendicular to an arrangement direction of said contact portions;

a guide member having a support member for holding and supporting said circuit board at a predetermined position and a pair of columns at ends thereof, each of said pair of columns having a holding portion provided at a respective side of the guide member corresponding to that of said supported portion, wherein said at least one of said supported portions of said circuit board has an asymmetric shape including a hole or a cut-off portion at an asymmetric position on one of the sides with respect to both said opposed directions and said arrangement direction and said holding portion has a corresponding shape to recieve said asymmetric shape therein and wherein a projection extends from said holding portion and is plugged into said hole or said cut-off portion.

* * * * *